US005489970A

United States Patent [19]

Nishida

[11] Patent Number: 5,489,970

[45] Date of Patent: Feb. 6, 1996

[54] FEEDING TIMING CONTROL FOR AN IMAGE FORMING APPARATUS

[75] Inventor: Ikuo Nishida, Kawasaki, Japan

[73] Assignee: Kabushiki Kaisha Toshiba, Kawasaki, Japan

[21] Appl. No.: 203,416

[22] Filed: Mar. 1, 1994

[30] Foreign Application Priority Data

Mar. 29, 1993 [JP] Japan ..... 5-069785

[51] Int. Cl.[6] ..... G03G 21/00

[52] U.S. Cl. ..... 355/208; 355/308; 355/316

[58] Field of Search ..... 355/308, 309, 355/316, 205, 207, 208

[56] References Cited

U.S. PATENT DOCUMENTS

| | | | |
|---|---|---|---|
| 5,073,802 | 12/1991 | Sugiyama | 355/309 X |
| 5,221,949 | 6/1993 | Miyamoto | 355/309 |
| 5,329,345 | 7/1994 | Nagatani et al. | 355/316 |

FOREIGN PATENT DOCUMENTS 4-80154 3/1992 Japan .

*Primary Examiner*—Nestor R. Ramirez
*Attorney, Agent, or Firm*—Foley & Lardner

[57] ABSTRACT

According to a paper conveying apparatus and a copying machine of the present invention, when a paper is supplied from a back cassette provided at a position where at least one cassette is provided between a photoconductive drum and the cassette, and a first paper supplied to the photoconductive drum is conveyed to an aligning roller of the copying machine, a second paper sequentially after the first paper arrived at the aligning roller is drawn from the back cassette in advance. Due to this, paper conveying time necessary for conveying the paper is reduced when a continuous copying is performed. If a back edge of the first paper is left on an intermediate aligning roller, that is, the whole length of paper drawn from the back cassette is longer, the second paper is stopped at the position where the second paper is drawn from the back cassette. Therefore, the first paper and second paper can be prevented from being collided with each other, and being overlapped on each other.

5 Claims, 10 Drawing Sheets

FEEDING TIMING CONTROL FOR AN IMAGE FORMING APPARATUS

BACKGROUND OF THE INVENTION

1. Field of the Invention

The present invention relates to an image forming apparatus wherein an image on a document is converted to an electrostatic latent image by an electrostatic image forming process, and toner is supplied to the latent image, thereby a toner image is formed to be printed out on a sheet material.

2. Description of the Related Art

An image forming apparatus, e.g., a copying apparatus has an image reading section for reading an image of a document, an image forming section for forming a toner image from the image read by the image reading section, and a material conveying section for conveying sheet materials for holding the toner image formed by the image forming section.

The image reading section has a document table on which the document is mounted, and reads the image of the document as image data, and transmits image data to the image forming section.

The material conveying section includes a plurality of cassettes, which can contain a plurality of types of paper having a different size and a different direction, and a multi-stage paper feeding device (expansion feeding device), which can feed paper having a different size and a different direction, and at least one of conveyor devices conveys the paper having a desired sized to the image forming section.

The image forming section has a photoconductive drum, a developing device, and a copy starting switch. On the photoconductive drum, an electrostatic latent image is formed in accordance with image data. The developing device supplies toner to the latent image formed on the photoconductive drum to be developed. The copy starting switch designates the start of copying to start the image formation. Then, the image forming section outputs the image formed based on image data to paper conveyed by the conveying section.

Paper materials are contained in each cassette, and picked up one by one from the top in order. The picked up one paper is conveyed to the photoconductive drum of the image forming section by a plurality of conveying rollers arranged in the apparatus. Then, the top edge portion of paper is arrived at an aligning roller arranged in the vicinity Of the photoconductive drum, and once stopped in a state that paper itself is curved.

The top edge portion of paper collides with the aligning roller, so that an inclination of the top edge in the conveying direction, which occurs when paper is conveyed from the cassette by the conveying rollers, is removed. After paper is temporarily stopped by the aligning roller, paper is conveyed to the photosensitive drum of the image forming section in a state that timing between the top edge of the image formed on the photoconductive drum and the top end of paper is matched when the aligning roller is rotated. Then, the paper is conveyed to the photoconductive drum of the image forming section, and receives the image formed on the photoconductive drum.

A detector, which detects a back edge of paper being conveyed to the aligning roller, is provided at a predetermined position of the side of conveying rollers. At the time when the back edge of paper is detected by the detector, next paper is picked up from the same cassette.

In this way, next paper is picked up in advance after paper conveyed to the photoconductive drum, thereby time necessary for continuous copying can be reduced.

In the above apparatus, a distance between the desired cassette and the photoconductive drum, i.e., a paper conveying distance is increased as the apparatus is large-sized and a plurality of cassettes is provided. The paper conveying distance is further increased as the apparatus has the multi-stage paper feeding device. In other words, as the paper conveying distance is longer, there is needed increase in the number of mechanisms for removing an inclination of a top edge and the number of detectors.

However, in the case that the plurality of the inclination removing mechanisms and the detectors are provided, when the first paper is stopped by the inclination removing mechanism, which is the closest to the photoconductive drum, there occurs a case that a next picked up paper is stopped between the inclination removing mechanism and the detector, which are provided in the middle of the paper conveying, due to the length of the paper and slight change of the conveying speed. In this case, there often occur the problems that the next picked up paper and a sequentially picked up paper 10 are collided with other and that the papers are jammed. Also, the next picked up paper and the sequentially picked up paper may be jammed at the portion close to the photoconductive drum or wound around the photoconductive drum.

SUMMARY OF THE INVENTION

The present invention relates to a copying machine having various types of functions, and an object of the present invention is to provide an image forming apparatus which can form an image on a paper having a size which a user wishes to copy.

The present invention has been made in consideration of the above-mentioned problems.

According to the present invention, there is provided a paper feeding device, comprising: means for holding sheet materials to support; first conveying means for picking up the sheet material from the holding means and conveying the sheet material one by one; second conveying means for further conveying the sheet material conveyed from the first conveying means; detecting means, provided between the first conveying means and the second conveying means, for detecting the sheet material conveyed to the second conveying means from the first conveying means; and means for controlling the first conveying means when the second conveying means is worked for a predetermined time after it is detected by the detecting means that the trailing edge of the sheet material is passed, and for stopping the first conveying means when to convey the sheet material the second conveying means is stopped within a predetermined time after it is detected that the trailing edge of the sheet material is passed.

Also, according to the present invention, there is provided an image forming apparatus, comprising: means for holding sheet materials to support an image formed on an image bearing member; first, second and third conveying means, provided along a direction where the sheet material picked up from the holding means is directed to the image bearing member in order, for conveying the sheet material picked up from the holding means to the image bearing member; first detecting means, provided between the first conveying means and the second conveying means, for detecting the position of the sheet material conveyed to the second conveying means from the first conveying means; second detecting means, provided between the second conveying means and the third conveying means, for detecting the position of the sheet material conveyed to the third conveying means from the second conveying means; and means for controlling the first, second and third conveying means, the controlling means stops the third and second conveying means in a predetermined time after it is detected by the second detecting means that a top edge of the sheet material is passed, and selectively drives the first conveying means in accordance with a passing time after it is detected by the first detecting means that a back edge of the sheet material is passed when the second conveying means is stopped.

Moreover, according to the present invention, there is provided an image forming apparatus, comprising: an image bearing member on which an image is formed; first, second and third holding means for holding sheet materials to be able to be supplied to the image bearing member; conveying means, provided close to the image bearing means, for conveying the sheet material supplied from each of the first, second and third holding means by a predetermined timing; first detecting means, provided at a position close to the conveying means and a side where sheet material directing to the conveying means is approached, for detecting that the sheet material is moved to a portion close to the conveying means; first material moving means, provided between the conveying means and the first holding means, for temporarily stopping the sheet material and for conveying to the conveying means from the first, second, and third holding means; second detecting means, provided at a position close to the first material moving means and a side where the sheet material directing to the first moving means is approached, for detecting that the sheet material is moved to a portion close to the first moving means; second material moving means, provided between the first material moving means and the second holding means, for temporarily stopping the sheet material and for conveying to the first material moving means from the second and third holding means; third detecting means, provided at a position close to the second sheet material moving means and a side where the sheet material directing to the second moving means is approached, for detecting that the sheet material is moved to a portion close to the second moving means; third material moving means, provided between the second material moving means and the third holding means, for temporarily stopping the sheet material and for conveying to the second material moving means from the third holding means; fourth detecting means, provided at a position close to the third sheet material moving means and a side where the sheet material directing to the third moving means is approached, for detecting that the sheet material is moved to a portion close to the third moving means; and control means for selectively controlling the moving means positioned at a portion away from the conveying means than the moving means in which the top edge of the sheet material is stopped based on the detection output from the second to fourth detection means provided between each moving means and each holding means in order that the conveying means and the first moving means are stopped in a predetermined time after it is detected by the first detecting means that a top edge of the sheet material is passed, in order that when a period of time, which is from when it is detected by the second detecting means that the back edge of the sheet material is passed till the first moving means is stopped is shorter than a predetermined time, the second moving means is stopped so as to temporarily stop a next sheet material at the position of the second moving means, and at time when the first detecting means detects that the back edge of the sheet material is moved, the second and first moving means are urged and the second detecting means detects that the top edge of the next sheet material is passed, thereafter the first and second moving means are stopped in a predetermined time, and in order that when a period of time, which is from when it is detected by the third detecting means that the back edge of the next sheet material is passed till the second moving means is stopped is shorter than a predetermined time, the third moving means is stopped so as to temporarily stop a further next sheet material at the position of the third moving means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

An embodiment of the present invention will be explained with reference to the drawings.

Figure 1:
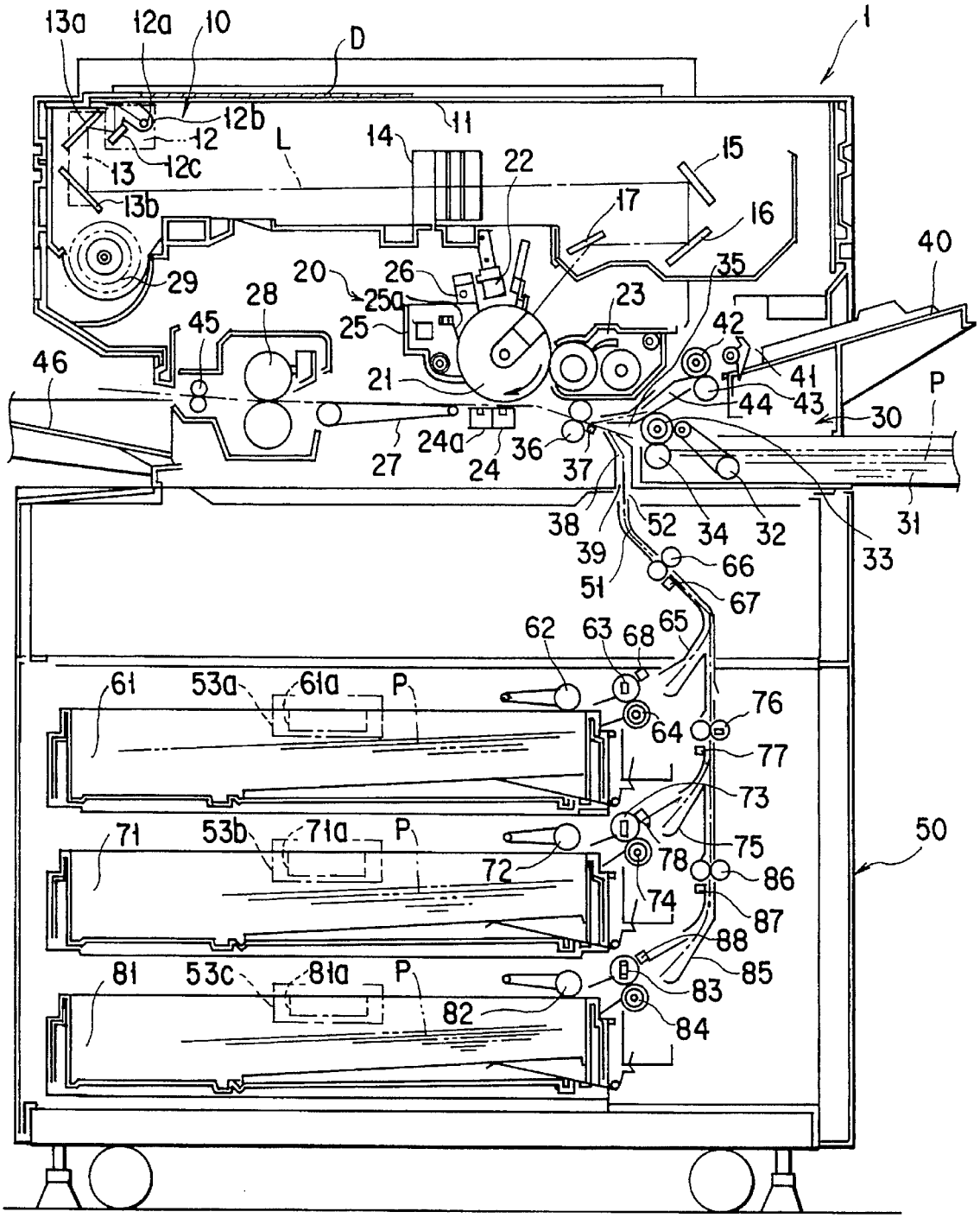
FIG. 1 is a schematic front view showing a copying machine in which an embodiment of the present invention is incorporated.

According to FIG. 1, a copying machine (image forming apparatus) 1 has an image reading section 10, an image forming section 20, and a paper conveying section (material conveying section) 30. The image reading section 10 reads an image of a document (copying object) D. The image forming section 20 forms a toner image based on the image read by the image reading section 10. The paper conveying section 30 conveys paper sheet P to which the image formed by the image forming section 20 is transferred.

The image reading section 10 has a document table 11, first and second carriages 12 and 13, and a converging lens 14. A document D is mounted on the document table 11. The first and second carriages 12 and 13 extract image data of the document D mounted on the table 11 as data of light brightness, and transmit image data to a photoconductive drum 21 (to be explained later). The converging lens 14 provides a magnification, which is based on a copy magnification inputted from a console panel (not shown), to image data transmitted to the photoconductive drum 21.

The first carriage 12 has an illumination lamp 12*a*, a reflector 12*b*, and a first mirror 12*c*. The illumination lamp 12*a* illuminates the document D mounted on the table 11. The reflector 12*b* focuses light from the illumination lamp 12*a* onto a predetermined position of the document D on the table 11. The first mirror 12*c* transmits reflected light L from the document D to the second carriage 13.

The second carriage 13 has second and third mirrors 13*a* and 13*b*, which reflect reflected light L transmitted from the first mirror 12*c*, is driven by the first carriage 12 at a half speed of the first carriage 12.

The lens 14 is movable along an optical axis by a moving mechanism (not shown). The lens 14 is moved to a predetermined position based on the copying magnification inputted from the console panel (not shown), so that reflected light L from the document D is converted to a desired size, and an image is formed on the surface of the photoconductive drum 21.

It is noted that fourth to sixth mirrors 15 to 17, which further reflect reflected light L transmitted through the lens 14, are provided between the lens 14 and the photoconductive drum 21. Also, the fourth and fifth mirrors 15 and 16 are movably provided in accordance with the copying magnification by the mirror moving mechanism (not shown) in order to correct the change of the distance between the table 11 and the surface of the photoconductive drum 21, which is caused by moving the lens 14 based on the copying magnification.

The image forming section 20 has the photoconductive drum 21, a main charging device 22, a developing device 23, a transfer unit 24, a cleaner unit 25, and a discharging unit 26. On the photoconductive drum 21, image data of the document D mounted on the table 11 is formed by an electrostatic copying process. The main charging device 22, developing device 23, transfer unit 24, cleaner unit 25, and discharging unit 26 are provided around the photoconductive drum 21 along a direction where the drum 21 is rotated in order.

The main charging device 22 includes a corona wire (not shown), and supplies a predetermined electric charge to the surface of the photoconductive drum 21 by discharge from the corona wire based on a high voltage current supplied from a high voltage power source (not shown). The developing device 23 includes toner (not shown) and carrier (not shown), and selectively supplies toner to an electrostatic latent image formed by reflected light L of the document D from the image reading section 10, so that the latent image is developed, and a toner image is formed on the photoconductive drum 21. The transfer unit 24 is located at a transferring area opposite to the photoconductive drum 21. The transfer unit 24 transfers the toner image to paper supplied through the paper conveying section 30.

It is noted that a separating (AC charge) unit 24a is integrally provided in the transfer unit 24. The separating unit 24 is used to separate paper on which the toner image is transferred from the photoconductive drum 21. The cleaner unit 25 includes a scraper (elastic blade) 25*a*, which is extended in a longitudinal direction of the photoconductive drum 21. The scraper 25*a* is pressed to the photoconductive drum 21. Thereby, the cleaner unit 25 removes toner, which is left on the photoconductive drum 21 after the toner image is transferred by the transfer unit 24. The discharging unit 26 includes a lamp (not shown). The lamp emits light having a predetermined intensity is provided to the photoconductive drum 21. Thereby, the discharge unit 26 removes the electric potential left on the photoconductive drum 21.

In the lower stream of the transfer area, there are provided a conveyer belt 27 and a fixing unit 28. The conveyer belt 27 conveys paper to which the toner image is transferred to the outer area of the copying machine 1. The toner image on paper conveyed by the convey belt 27, the fixing unit 28 fixes the toner image to paper.

The fixing unit 28 has a heat roller and a press roller. The axes of these rollers are provided to be parallel to each other, and both rollers are pressurized each other. The fixing unit 28 melts toner on paper on which the toner image is electrostatically formed by a fixing area, which is defined between the above rollers, so that the toner image is fixed to paper P.

In the vicinity of the fixing unit 28, a cooling fan 29 is provided so as to protect the photoconductive drum 21 from heat generated by the fixing unit 28, and to discharge heat of the inside of the copying machine 1.

The paper conveying section 30 has a cassette 31, a bypass-feeder 40, and a large number of sheet guiding elements such as guide plates and conveying mechanisms such as rollers. The cassette 31 holds sheet paper, which is used to receive the toner image formed on the photoconductive drum 21, to be supplied to the photoconductive drum 21 of the image forming section 20. The bypass-feeder 40 can supply paper independently of the cassette 31. The sheet guiding elements and conveying mechanisms are used to discharge paper to which the toner image is formed by the transfer device 24 to the outer unit of the copying machine 1.

A picking up roller 32, a convey roller 33, a separating roller 34, and a guiding path 35 are provided in the upper portion of the cassette 31 in order. The picking up roller 32 picks up paper, which is stacked in the cassette 31, one by one from the uppermost portion. The convey roller 33 is provided between the cassette 31 and the photoconductive drum 21. The convey roller 33 is rotated in the same direction as the picking up roller 32, thereby conveying paper, which is picked up by the picking up roller 32, to the photoconductive roller 21. The separating roller 34 is provided such that the convey roller 33 and the axes of the roller 34 are parallel to each other and paper can be passed between the rollers 33 and 34. Normally, by rotating the roller 34 in the same direction as the roller 33, papers other than paper placed on the upper portion are pressed back when two or more papers are picked up and conveyed from the cassette. The guide path is formed of at least one plate-like member, and is used to guide paper, which is passed between the rollers 33 and 34, to the photoconductive drum 21.

An aligning roller 36 is provided between the guiding roller 35 and the photoconductive drum 21. By temporarily stopping the paper passed through the path 35, the aligning roller 36 corrects the inclination of the paper, which is being conveyed, to the transferring direction, and adjusts timing between the toner image formed on the photoconductive drum 21 and the paper. An aligning sensor 37 is provided in a portion which is close to the aligning roller 36 and between the roller 36 and the path 35. The aligning sensor 37 detects that paper to be stopped by the aligning roller 36 approaches the aligning roller 36.

It is noted that a path 38 and an opening 39 are formed between the guiding path 35 and the cassette 31. The path 38 is used to send papers supplied from a paper feed pedestal to be explained later to the path 35.

A paper detector 41, a conveying roller 42, a separating roller 43, and a path 44 are provided between the bypass feeder 40 and the path 35. The detector 41 detects that papers are set in the bypass feeder 40. The conveying roller 42 conveys papers stacked in the bypass feeder 40 in order. The separating roller 43 separates papers, which are conveyed by the conveying roller 42, into one. The path 44 is used to send one paper, which is passed between the rollers 42 and 43, to the path 35 already explained.

A discharging roller 45 is provided in a direction where paper to which the toner image is transferred by the transfer unit 24 is conveyed with the rotation of the photoconductive drum 21, and a portion, which is the outer side of the fixing device 28. The roller 45 is used to discharge paper to which the toner image is fixed by the fixing device 28 to the outer unit of the copying machine 1. Also, a tray 46 is provided in the outer unit of the copying machine 1. On the tray 46, papers discharged through the discharging roller 45 are stacked.

A paper feed pedestal 50 is provided in the lower portion of the copying machine 1. The paper feed pedestal 50, which is formed separately from the copying machine 1, supports the copying machine 1. Similar to the paper conveying section 30 of the copying machine 1, the paper feed pedestal 50 can continuously supply papers for receiving the toner image formed on the photoconductive drum 21 of the copying machine 1, for example, plane papers having various sizes.

Figure 2:
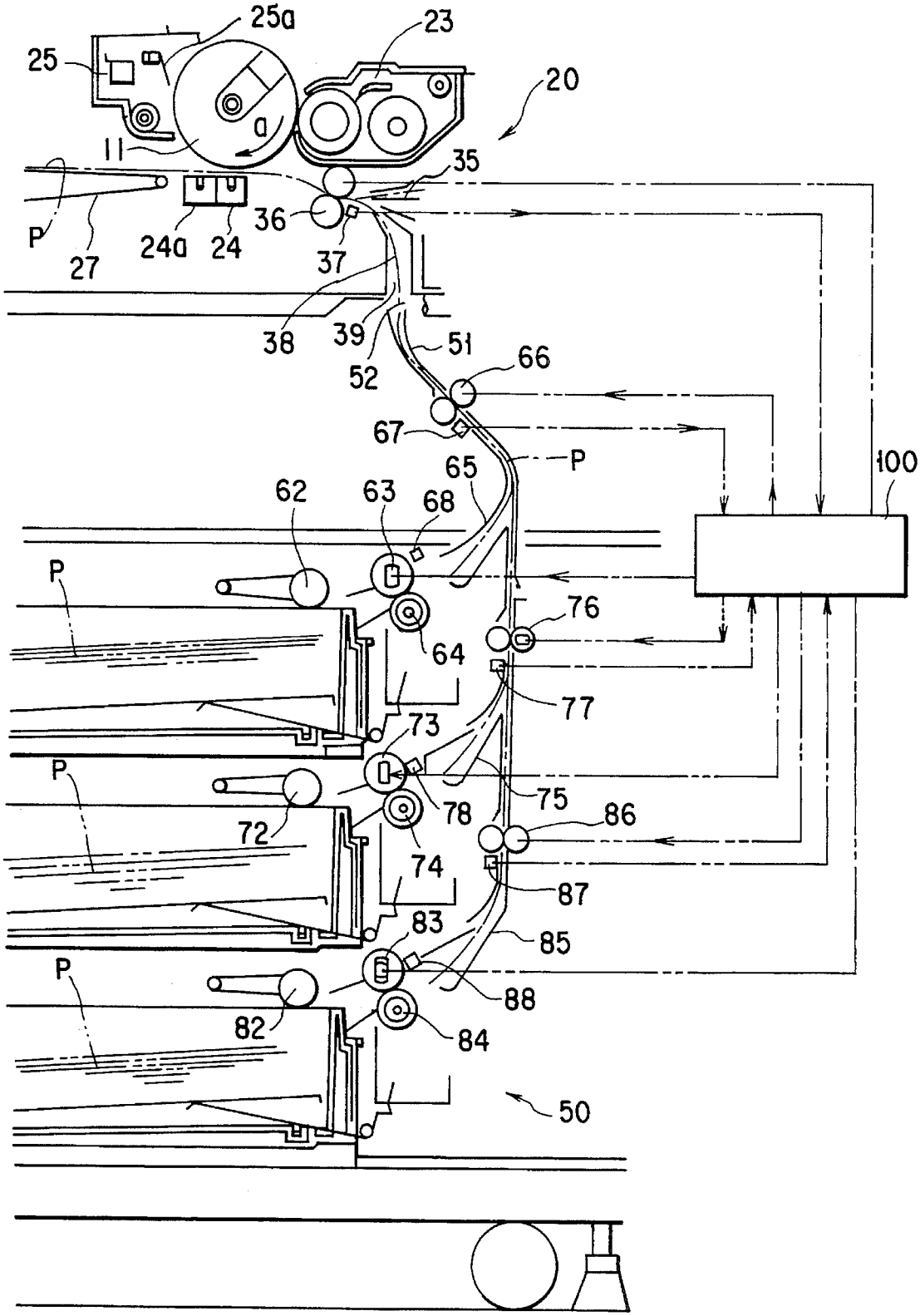
FIG. 2 is a partially enlarged view of a conveying device incorporated into the copying machine shown in FIG. 1.

According to FIG. 2, the paper feed pedestal 50 (hereinafter called as PFP) has a top convey guiding path 51 and an opening portion 52. The top convey guiding path 51 is used to allow papers P to be supplied through the opening portion 39 of the copying machine 1. The opening portion 52 is used to protect the connecting guide 51 and to connect the opening 39 to the PFP 50.

A plurality of cassettes 61, 71, and 81 and a large number of sheet guiding elements and conveying mechanisms such as rollers are provided in the lower portion of the connecting guide 51. The cassettes 61, 71, and 81 contain papers having various sizes and directions. The sheet guiding element and conveying mechanisms are used to convey papers to the path 51.

It is noted that these cassettes 61, 71, and 81 are formed to be slidable to the front surface side of the copying machine 1 by a cassette moving mechanism (not shown) such as slider rails, respectively. Moreover, when the respective cassettes 61, 71, and 81 are inserted, size sensors 53*a*, 53*b*, and 53*c* are incorporated into a portion corresponding to a size display section (explained later) provided in the respective cassettes. The size sensors 53*a*, 53*b* and 53*c* detect the size of paper P contained in each of cassettes 61, 71, and 81, respectively, based on data provided by the size display section.

A size display section 61*a* is provided at the end portion of the cassette 61, which is opposite to the size sensor 53*a* of PFP 50. The size display section 61*a* is used to display the size of paper P contained in the cassette 61. In the upper portion of the cassette 61, a picking up roller 62, a conveying roller 63, a separating roller 64, and an upper convey guiding path (upper guide) 65 are provided in order. The picking up roller 62 picks up paper stacked in the cassette 61 from the uppermost in order. The conveying roller 63 is provided between the cassette 61 and the connecting guide 51, and rotated in the same direction as the picking up roller 62 so as to convey paper picked up by the roller 62 to the connecting guide 51. The separating roller 64 is provided such that the convey roller 63 and the axes of the roller 64 are parallel to each other and paper can be passed between the rollers 63 and 64. Normally, by rotating the roller 64 in the same direction as the roller 63, papers other than paper 10 placed on the upper portion are pressed back when two or more papers are picked up and conveyed from the cassette. The upper guide path 65 is formed of plate-like members, and is used to guide one paper, which is passed between the rollers 63 and 64, to the connecting guide 51.

An aligning/conveying roller 66 is provided between the upper guide 65 and the connecting guide 51. By temporarily stopping the paper passed through the upper path 65, the aligning roller 66 corrects the inclination of the paper, which is being conveyed, to the conveying direction. Also, the aligning roller 66 is used to prevent paper newly picked up from the cassette 61 from being collided with paper already conveyed close to the photoconductive drum 21 and being overlapped on the already conveyed paper.

An aligning sensor 67 is provided at a portion which is close to the roller 66, and which is between the roller 66 and the path 65. The aligning sensor 67 detects that paper to be stopped by the roller 66 approaches the roller 66. Moreover, a paper edge sensor 68 is provided at a portion which is between the rollers 63 and 64 and the aligning sensor 67, and which is close to the rollers 63 and 64. The paper edge sensor 68 detects the back edge of paper conveyed from the cassette 61 and the top edge of paper to be sequentially conveyed.

It is noted that the picking up roller 62 is formed to be contactable/non-contactable with the uppermost paper contained in the cassette 61 by an up and down mechanism (not shown). When a copy starting is designated by the console panel (not shown), the picking up roller 62 is brought into contact with the uppermost paper, and picks up paper from the cassette 61. Moreover, the aligning/conveying roller 66 is arbitrarily rotated or stopped by the control of a controller 100 (to be explained later) based on the output of the aligning sensor 37 of the copying machine 1 and the output of the aligning sensor 67 of PFP 50.

A size display section 71*a* is provided at the end portion of the cassette 71, which is opposite to the size sensor 53*b* of PFP 50. The size display section 71*a* is used to display the size of paper P contained in the cassette 71. In the upper portion of the cassette 71, a picking up roller 72, a conveying roller 73, a separating roller 74, and a middle convey guiding path (central guide) 75 are provided in order. The picking up roller 72 picks up paper stacked in the cassette 71 from the uppermost in order. The conveying roller 73 is provided between the picking up roller 72 and the upper guide 65, and rotated in the same direction as the picking up roller 72 so as to convey paper picked up by the roller 72 to the upper guide 65. The separating roller 74 is provided such that the convey roller 73 and the axes of the roller 74 are parallel to each other and paper can be passed between the rollers 73 and 74. Normally, by rotating the roller 74 in the same direction as the roller 73, only paper placed on the uppermost portion are pressed back when two or more papers are picked up and conveyed from the cassette 71. The central guide 75 is formed of plate-like members, and is used to guide one paper, which is passed between the rollers 73 and 74, to the upper guide 65.

An aligning/conveying roller 76 is provided between the central guide 75 and the upper guide 65. The aligning roller 76 corrects the inclination of the paper, which is passed through the central guide 75, to the conveying direction. Also, the aligning roller 76 is used to prevent paper newly picked up from the cassette 71 from being collided with paper already conveyed close to the photoconductive drum 21 and being overlapped on the already conveyed paper.

An aligning sensor 77 is provided at a portion which is close to the roller 76, and which is between the roller 76 and the path 75. The aligning sensor 77 detects that paper to be stopped by the roller 76 approaches the roller 76. Moreover, a paper edge sensor 78 is provided at a portion which is between the rollers 73 and 74 and the aligning sensor 77, and which is close to the rollers 73 and 74. The paper edge sensor 78 detects the back edge of paper conveyed from the cassette 71 and the top edge of paper to be sequentially conveyed.

It is noted that the picking up roller 72 is formed to be contactable/non-contactable with the uppermost paper contained in the cassette 71 by an up and down mechanism (not shown). When a copy starting is designated by the console panel (not shown), the picking up roller 72 is brought into contact with the uppermost paper, and picks up paper from the cassette 71. Moreover, the aligning/conveying roller 76 is arbitrarily rotated or stopped by the control of a controller 100 (to be explained later) based on the output of the aligning sensor 67.

A size display section 81*a* is provided at the end portion of the cassette 81, which is opposite to the size sensor 53*c* of PFP 50. The size display section 81*a* is used to display the size of paper P contained in the cassette 81. In the upper portion of the cassette 81, a picking up roller 82, a conveying roller 83, a separating roller 84, and a lower convey guiding path (lower guide) 85 are provided in order. The picking up roller 82 picks up paper stacked in the cassette 81 from the uppermost in order. The conveying roller 83 conveys paper picked up by the picking up roller 82 to the central guide 75. The separating roller 84 is provided to pass paper between the rollers 83 and 84. Then, only paper placed on the uppermost portion are pressed back when two or more papers are picked up and conveyed from the cassette 81. The lower guide 85 is formed of plate-like members, and is used to guide one paper, which is passed between the rollers 83 and 84, to the central guide 75.

An aligning/conveying roller 86 is provided between the lower guide 85 and the central guide 75. The aligning roller 86 corrects the inclination of the paper, which is passed through the lower guide 85, to the conveying direction. Also, the aligning roller 86 is used to prevent paper newly picked up from the cassette 81 from being collided with paper already conveyed close to the photoconductive drum 21 and being overlapped on the already conveyed paper.

An aligning sensor 87 is provided at a portion which is close to the roller 86, and which is between the roller 86 and the path 85. The aligning sensor 87 detects that paper to be stopped by the roller 86 approaches the roller 86. Moreover, a paper edge sensor 88 is provided at a portion which is between the rollers 83 and 84 and the aligning sensor 87, and which is close to the rollers 83 and 84. The paper edge sensor 88 detects the back edge of paper conveyed from the cassette 81 and the top edge of paper to be sequentially conveyed.

It is noted that the picking up roller 82 is formed to be contactable/non-contactable with the uppermost paper contained in the cassette 81 by an up and down mechanism (not shown). When a copy starting is designated by the console panel (not shown), the picking up roller 82 is brought into contact with the uppermost paper, and picks up paper from the cassette 81. Moreover, the aligning/conveying roller 86 is arbitrarily rotated or stopped by the control of a controller 100 (to be explained later) based on the output of the aligning sensor 77.

It is needless to say that the distances between each of the aligning/conveying rollers 66 and 76, 76 and 86 and the aligning roller 36 and the aligning/conveying roller 66 and the distance between the respective rollers 66, 76, 86 and the respective rollers 62, 72, and 82 are defined to be narrower than the length of the paper having the shortest size which the copying machine can work.

Figure 3:
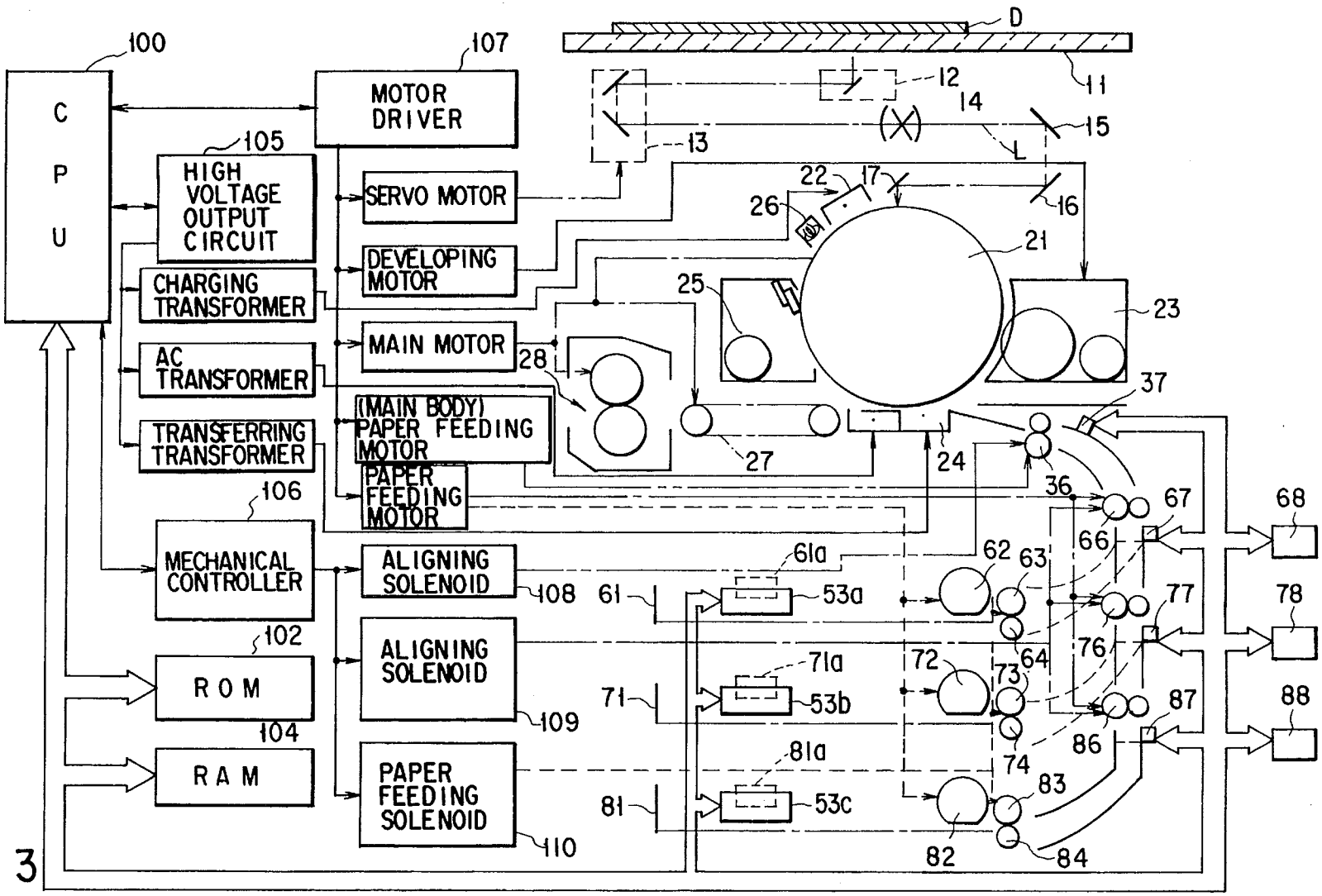
FIG. 3 is a block diagram showing a controlling section of the copying machine shown in FIG. 1.

According to FIG. 3, the controller 100 includes a CPU 101. A ROM 102 and a RAM 104 are connected to CPU 101 through a bus line 103. ROM 102 stores a rule for operating the copying machine, for example, amount of control for controlling the charging device 22, developing device 23, and transferring unit 24, and passing time when paper P is passed between the sensors corresponding to the respective aligning/conveying rollers, and size data for detecting the size of paper contained in each cassette based on the size display of each cassette. RAM 104 temporarily stores data of the number of papers to be copied inputted from the console panel (not shown), magnification data, and data of an operation state of the machine 1 outputted from each sensor such as the position of the roller by which the cassette and paper is being aligned. It is noted that size sensors 61*a*, 71*a*, and 81*a*, aligning sensors 37, 67, 77, and 87, and paper edge sensors 68, 78, and 88 are connected to the bus line 103.

Moreover, a high voltage output circuit 105, first and second aligning solenoids (or clutch) 107,108, a mechanical controller 106, a main motor, a developing motor, a servo motor, and a motor driver 107 are connected to CPU 101. The high voltage output circuit 105 urges transformers for supplying high voltage to the charging device 22, and the transferring unit 24. The first and second aligning solenoids 107 and 108 selectively transmit driving force from a paper conveying motor in order to independently provide rotating force to each of paper conveying rollers 32, 62, 72, and 82 for conveying paper P from each cassette and each of aligning rollers 36, 66, 76, and 86. The mechanical controller 106 turns on/off a conveying solenoid 109. The main motor rotates the photoconductive drum 21. The developing motor drives the developing device 23. The servo motor moves first and second carriages. The motor driver 107 is used to urge the paper conveying roller, conveying roller, and paper conveying motor for rotating aligning roller.

It is noted that the aligning roller 36 of the machine 1 is driven when the rotation of the paper conveying motor of the main body is selectively transmitted by the aligning solenoid 107. Also, the aligning/conveying rollers 66, 76, and 86 of PFP 50 are respectively driven when the rotation of the paper conveying motor of the main body is selectively transmitted by the aligning solenoid 108. In this case, the aligning solenoids are turned on/off simultaneously or independently by a predetermined timing to be described later.

The following will explain an operation of the copying machine 1 and that of PFP 50.

After the illumination lamp 12*a* of the first carriage 12 is turned on, the first and second carriages 12 and 13 are moved along the document table 11, thereby providing reflected light L of the document (copying object) D mounted on the document table 11. Reflected light L is reflected on the first mirror 12*c* of the first carriage 12, the second mirror 13*a* and the third mirror 13*b* of the second carriage 13 in order, and inputted into the lens 14.

The reflected light inputted to the lens 14 is enlarged/reduced in accordance with the inputted magnification by the lens 14, which is moved in accordance with the predetermined magnification inputted from the console panel (not shown). Thereby, an image is formed on the surface of the photoconductive drum 21.

The predetermined potential, which is charged in advance by the charging device 22, is partially reduced in accordance with image data of the document by the reflected light L. As a result, an electrostatic latent image is formed on the photoconductive drum 21.

The electrostatic latent image is conveyed to a developing area opposite to the developing device 23 in accordance with the rotation of the photoconductive drum 21. Then, the electrostatic latent image is developed by toner supplied from the developing device 23, and converted to a toner image.

The toner image is conveyed to a transferring position opposite to the transfer unit 24 in accordance with the rotation of the photoconductive drum 21. Then, the toner image is transferred to paper P, which is supplied from one of the cassette 31, bypass feeder 40, PFP 50, by the transfer unit 24.

Paper to which the toner image is transferred by the transfer unit 24 is detached from adsorption with the photoconductive drum 21 by the separating device 24*a*, and conveyed to the fixing device 28 through the conveying belt 27. Paper, which is guided to the fixing device 28, and the toner image, which is electrostatically adhered onto paper, are fixed to each other by the fixing device 28, and outputted to the tray 46.

In a case where paper P is supplied from any one of cassettes 61, 71, and 81 of PFP 50, paper P must be conveyed for a distance which is two to five times as long as the case that paper P is supplied from the cassette 31 or the bypass feeder 40. Therefore, in order to provide the same copying speed, i.e., the number of papers to be copied per a unit time, as the case that paper P is supplied from the cassette 31 or the bypass feeder 40, it is required that the second paper P, to which an toner image formed by the next operation is transferred, be drawn from its corresponding cassette continuously after the first paper P, which is temporarily stopped by the aligning roller 36.

The following will explain the processes of continuously drawing paper P from the respective cassettes 61, 71, and 81 of PFP 50.

For example, if the cassette 61 (cassette of the uppermost stage of PFP 50) is selected based on data inputted from the console panel (not shown), the pickup roller 62 is moved down by inputting a print start signal from the console panel.

Sequentially, the pickup roller 62 is rotated, and paper of the uppermost contained in the cassette 61 is supplied from the cassette 61.

One paper supplied from the cassette 61 is guided to the upper guide 65 after the passage is detected by turning on and off the paper edge sensor 68. In the case that two or more papers are supplied from the cassette 61, and only one paper on the upper is passed between the rollers 63 and 64.

The paper edge sensor 68 is turned on/off, so that the rollers 63 and 64 are stopped, and the pickup roller 62 is rotated again. As a result, the top edge of the second paper P, which is being conveyed toward the aligning roller 36 in the guide 51, is drawn from the cassette 61. By timing due to the control of CPU 101 to be explained later, a solenoid 110 is turned on, so that the rollers 63 and 64 are rotated again, and the second paper P is conveyed to the aligning roller 36.

After it is detected that the first paper P is guided to the upper guide 65, the first paper P is further pushed by the aligning/conveying roller 66, and guided to the guide 51.

Paper guided to the guide 51 is passed through the opening 52 of PFP 50 and the opening 39 of the copying machine 1, and supplied to the path 35 through the path 39 of the copying machine 1.

Paper P guided to the path 35 is further transported by the aligning/conveying roller 66, and guided to the aligning roller 36.

The top edge of paper P guided to the aligning roller 36 is brought in contact with the aligning roller 36. Then, paper P is transported by the aligning/conveying roller 66 until being slightly bent. Thereafter, paper P is stopped. At this time, the aligning roller 36 is stopped, thereby removing an inclination of paper P to the moving direction, which may be generated when the paper is conveyed from the cassette 61 to the aligning roller 36.

When the top edge of paper P is detected by the aligning sensor 37, the aligning/conveying roller 66 is stopped after a predetermined time $T_1$. In this case, the predetermined time $T_1$ is the time in which a predetermined float a for providing a bend to paper is added to a distance $D_1$ between the aligning sensor 37 and the aligning roller 36 and the rotation speed of the outer peripheral surface of the photoconductive drum 21, i.e., paper passing time $t_1$, which is defined by the rotation speed of the outer peripheral surface of the aligning roller 36. The times $t_1$ and $T_1$ are stored in the ROM 102.

Thereafter, time $T_{66}$ (substantially a distance), which is time from when the conveying paper is passed through the aligning sensor 67 of the upper stream of the roller 66 and conveyed till the aligning/conveying roller 66 is stopped, is estimated.

Figure 4A:
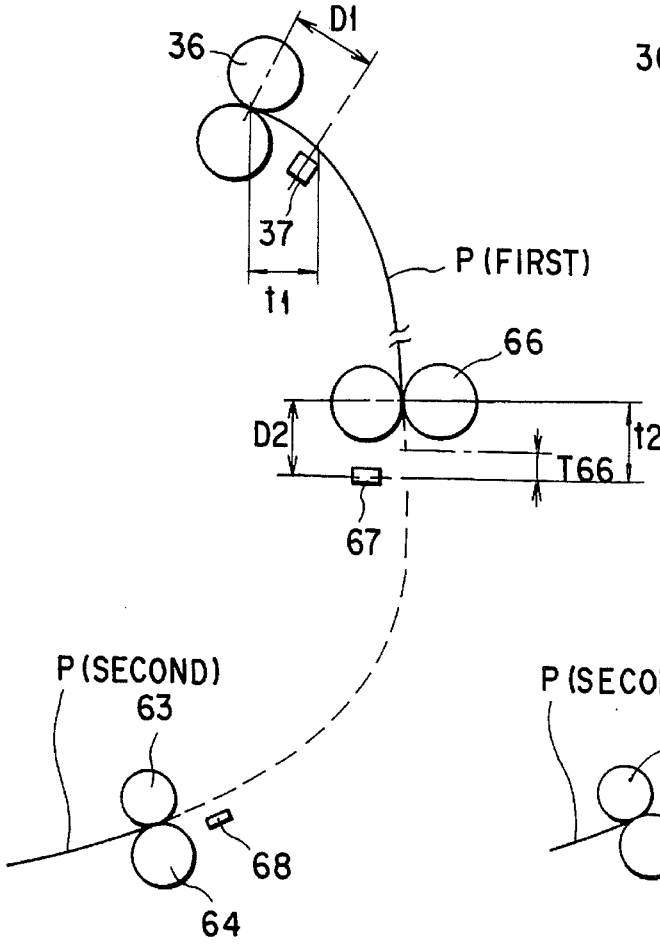
FIGS. 4A and 4B are schematic views showing a state of paper to be conveyed from a cassette of an uppermost stage in the conveying device shown in FIG. 2.

As shown in FIG. 4A, the top edge of paper P is detected by the aligning sensor 37, and the aligning/conveying roller 66 is stopped after predetermined time $T_1$. Thereby, paper P is stopped in a state that the top edge of paper P collides with the aligning roller 36. In a case where the back edge of paper P is passed through the sensor 67 by the time that the aligning/conveying roller 66 is stopped, time $T_{66}$ is compared with distance $D_2$ between the sensor 67 and roller 66 and the rotation speed of the outer peripheral surface of the photoconductive drum 21, that is, predetermined time $t_2$, which is defined by the rotation speed of the outer peripheral surface of the roller 66 (time $t_2$ is defined when PFP 50 is manufactured, and $t_2$ and $T_2$ are stored in ROM 102 in advance).

If $t_2>T_{66}$, it is detected that the back edge of paper P is not detached from the roller 66. In this case, the rollers 63 and 64 are stopped as they are by CPU 101. Therefore, next paper P drawn from the cassette 61 is stopped without being conveyed to the roller 66.

Figure 4B:
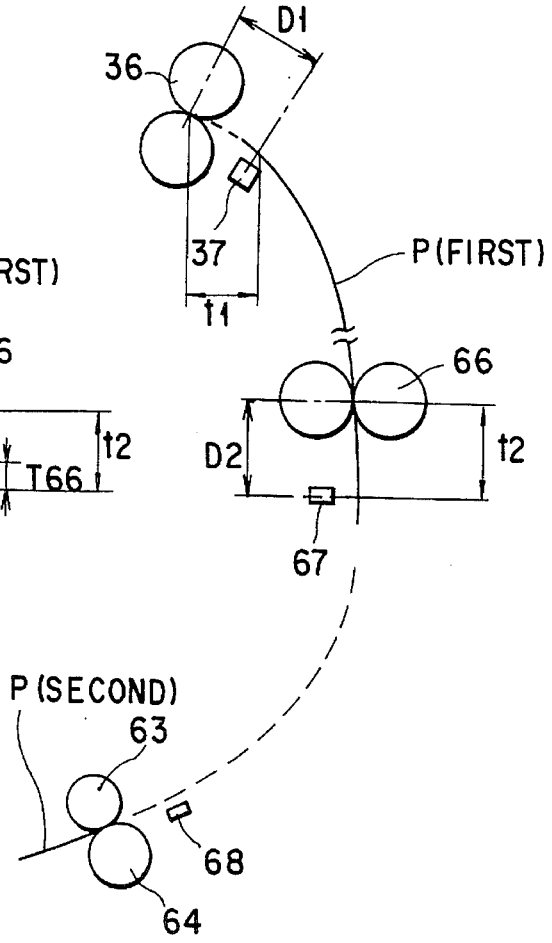

As shown in FIG. 4B, in the case that the top edge of paper is detected by the sensor 37, thereafter the back edge thereof is not detected in spite of the fact that the roller 66 is rotated for the predetermined time $T_1$, it is detected that the whole length of paper P is longer. Then, it is needless to say that next paper P is stopped in a state that the top edge of paper is drawn from the cassette 61. The state shown in FIG. 4B is the state that the back edge of second paper P is not passed through the aligning sensor 67. Therefore, it is needless to say that the sensor 67 is not turned off, thereby the state can be detected.

Thereafter, aligning solenoids 108 and 109 are turned on by a predetermined timing in accordance with the rotation of the photoconductive drum 21 (movement of the toner image) of the copying machine 1. Thereby, the rollers 36 and 66 are rotated, and paper P, which is stopped by the roller 36, is transferred to the transferring area. When the back edge of paper P is passed through the aligning solenoid 109 is stopped, that is, the output of the sensor 37 is turned off, the roller 66 is stopped, and the rollers 63 and 64 are rotated. Thereby, second paper P is conveyed to the roller 66.

The entrance of the second paper P to the path 65 is detected by the aligning sensor 67. Thereafter, the second paper P is further conveyed to be guided to the guide 51 by the roller 66. Thereafter, the second paper P is conveyed to the photoconductive drum 21 by the same process as the first paper P.

Figure 5:
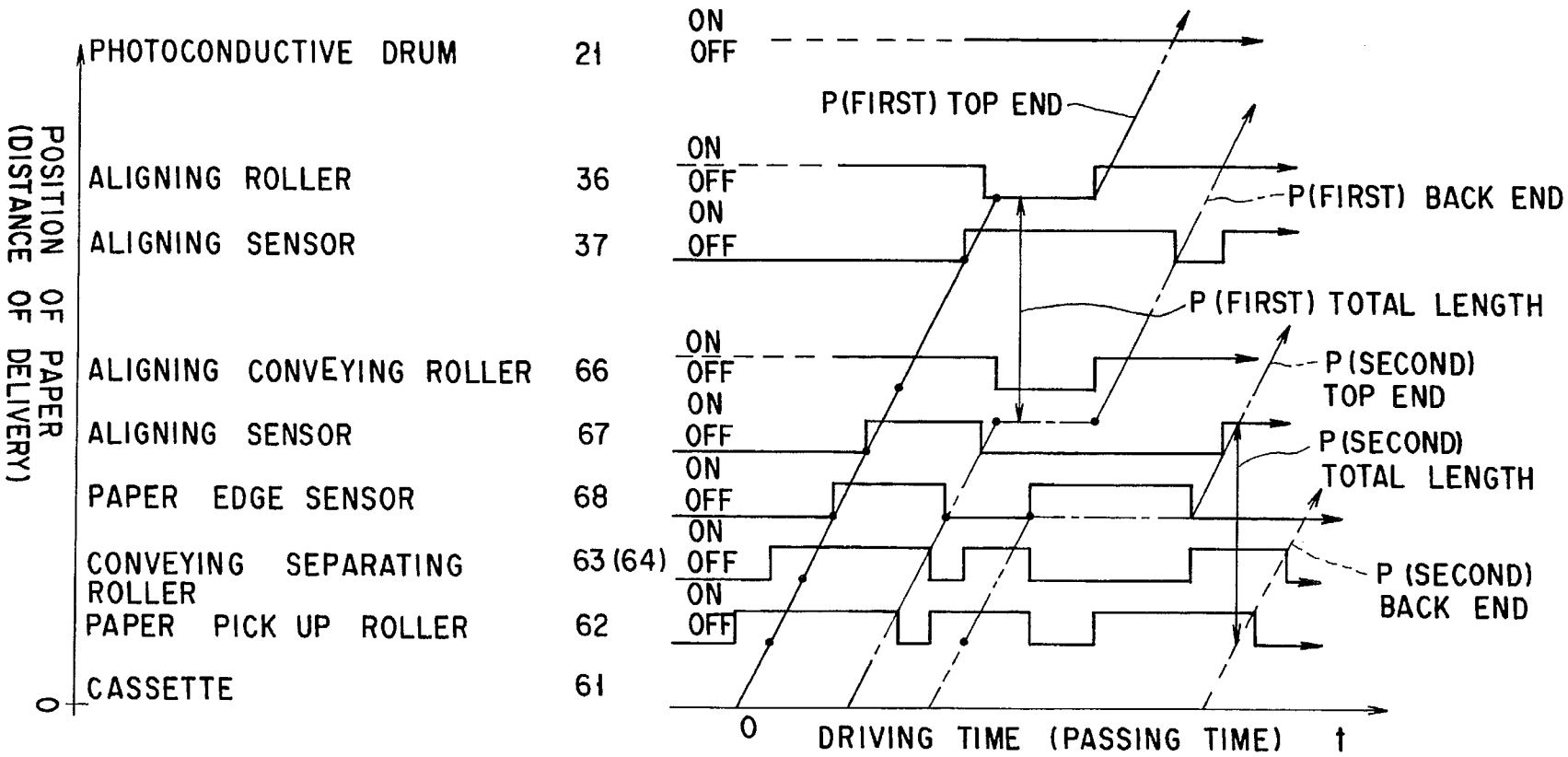
FIG. 5 is a diagram showing timing for controlling rollers to provide the paper conveying state shown in FIGS. 4A and 4B.

FIG. 5 shows a diagram schematically showing timing for controlling the aligning roller 36, aligning/conveying roller 65, conveying roller 63, separating roller 64, and pickup roller 62 (cassette 61), which are shown in FIGS. 4A and 4B, and showing the state that first paper P (shown by P (FIRST)) and second paper P (shown by P (SECOND)) are moved.

More specifically, as explained above, in the case of $t_2>T_{66}$, it is detected that first paper P is between the aligning/conveying roller 66 and the sensor 67. Sequentially, the second paper P is temporarily stopped by the conveying roller 63 and the separating roller 64 (sensor 68). Thereby, papers are prevented from being collided with each other, and being overlapped on each other.

Figure 6A:
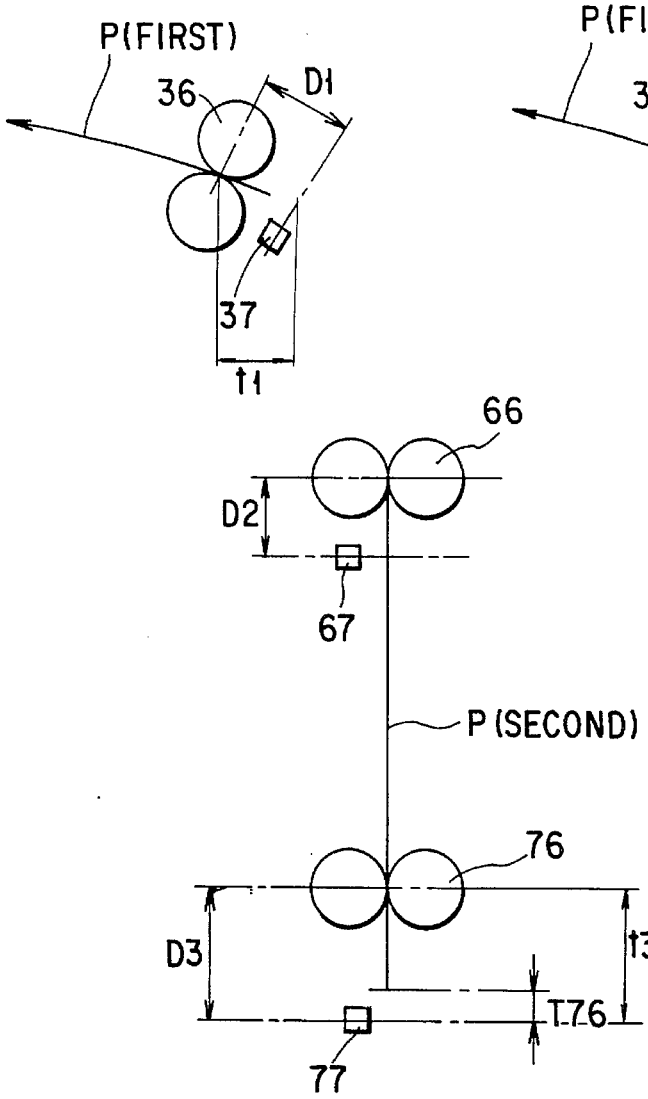
FIGS. 6A and 6B are schematic views showing a state of paper to be conveyed from a cassette of a middle stage in the conveying device shown in FIG. 2.
Figure 6B:
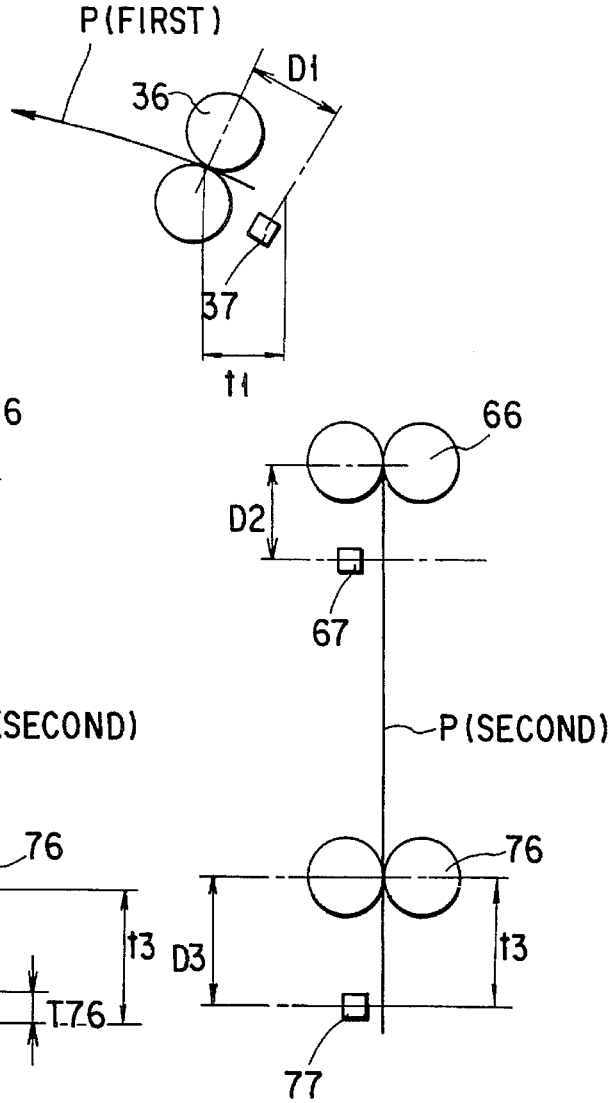

According to FIGS. 6A and 6B, if paper P, which is conveyed to the copying machine 1, is picked up from the cassette 71, the copy start key (not shown) is turned on, so that first paper P (FIRST) is drawn from the cassette 71.

It is detected that the first paper drawn from the cassette 71 is detached from the cassette. Thereafter, the first paper P (FIRST) is guided to the central guide 75. The first paper P (FIRST) guided to the central guide 75 is passed through the aligning/conveying roller 76, upper guide 65, aligning/conveying roller 66, connecting guide 51, and path 38 in order, and conveyed to the aligning roller 36. At this time, it is detected whether or not the back edge of first paper P is passed through the sensor 67 by the same method as explained in FIGS. 4A and 4B. Also, in the case that the back edge of first paper P is passed, it is detected whether or not the back edge of first paper P is located between the roller 66 and sensor 67 by the same method as explained in FIGS. 4A and 4B. Therefore, the predetermined time $t_2$ is compared with time $T_{66}$, which is from time when paper P (FIRST) is passed through the sensor 67 till the roller 66 is stopped.

If $t_2>T_{66}$, the second paper P (SECOND) whose top edge portion of paper is drawn from the cassette 71 is stopped by the rollers 73 and 74 till the solenoid 110 is turned on by timing (to explained later) due to the control of CPU 101.

On the other hand, in the case that the first paper P, which is stopped by the roller 36, is conveyed to the photoconductive drum 21, so that the back edge portion of the first paper P is passed through the sensor 37, that is, the sensor 37 is turned on, the second paper P (SECOND), which is stopped by the roller 73 and 74, is conveyed to the central guide 75 by turning on the solenoid 110.

The entrance of the second paper P (SECOND) to the path 75 is detected by the aligning sensor 77. Thereafter, the second paper P guided to the central guide 75 is further conveyed to be guided to the upper guide 65 by the roller 66.

The top edge portion of the second paper guided to the upper guide 65 is passed through the aligning sensor 67, and collided with the roller 65. Thereafter, the aligning/conveying roller 66 is stopped by the 10 predetermined timing, thereby removing the inclination of paper in the direction perpendicular to the direction where the paper is conveyed. In other words, the top edge portion of the second paper P is passed through the aligning sensor 67, and the aligning/conveying roller 76 is stopped after a predetermined time $T_2$. In this case, $T_2$ is time in which a predetermined float D for providing bend to paper P is added to time $t_2$ for which paper is conveyed between the aligning sensor 67 and the aligning/conveying roller 66.

Thereafter, it is detected whether or not the back edge of the second paper P is passed through the aligning sensor 77. If the back edge of the second paper P is passed therethrough, it is detected whether or not the back edge of the second paper P is between the roller 76 and the sensor 77. In other words, in the case that the back edge of the second paper P is passed through the aligning sensor 77, time $T_{76}$ (substantially a distance), which is time from when the second paper P is passed through the aligning sensor 77 of the upper stream of the roller 76 and conveyed, is estimated. Then, time $T_{76}$ is compared with a distance $D_3$ between the sensor 77 and roller 76 and the rotation speed of the outer peripheral surface of the photoconductive drum 21, that is, predetermined time $t_3$, which is defined by the rotation speed of the outer peripheral surface of the roller 76 (time $t_3$ is defined when PFP 50 is manufactured, and stored in ROM 102 in advance).

At this time, if $t_3>T_{76}$, it is detected that the back edge of paper P is not detached from the roller 76. In this case, the rollers 73 and 74 are stopped as they are by CPU 101. Therefore, next paper P drawn from the cassette 71 is stopped without being conveyed to the roller 76. The state shown in FIG. 6B is the state that the back edge of second paper P is not passed through the aligning sensor 77. Therefore, it is needless to say that the sensor 77 is not turned off, thereby the state can be detected.

Thereby, in the case that paper P is supplied from the cassette 71, when the first paper P, which is supplied to the photosensitive drum 21, is conveyed up to the roller 36 of the copying machine 1, the second paper P sequentially after the first paper P arrived at the roller 36 is drawn from the cassette 71 in advance, and conveyed to the roller 76. Due to this, paper conveying time, which is necessary to convey paper in continuously copying, can be reduced. In the case that the back edge portion of the first paper P stays at the roller 76, that is, the whole length of the paper drawn from the cassette 71 is longer, the second paper P is stopped at the position where the second paper P is drawn from the cassette 71. Therefore, first and second papers can be prevented from being collided with each other, and being overlapped on each other.

Figure 7:
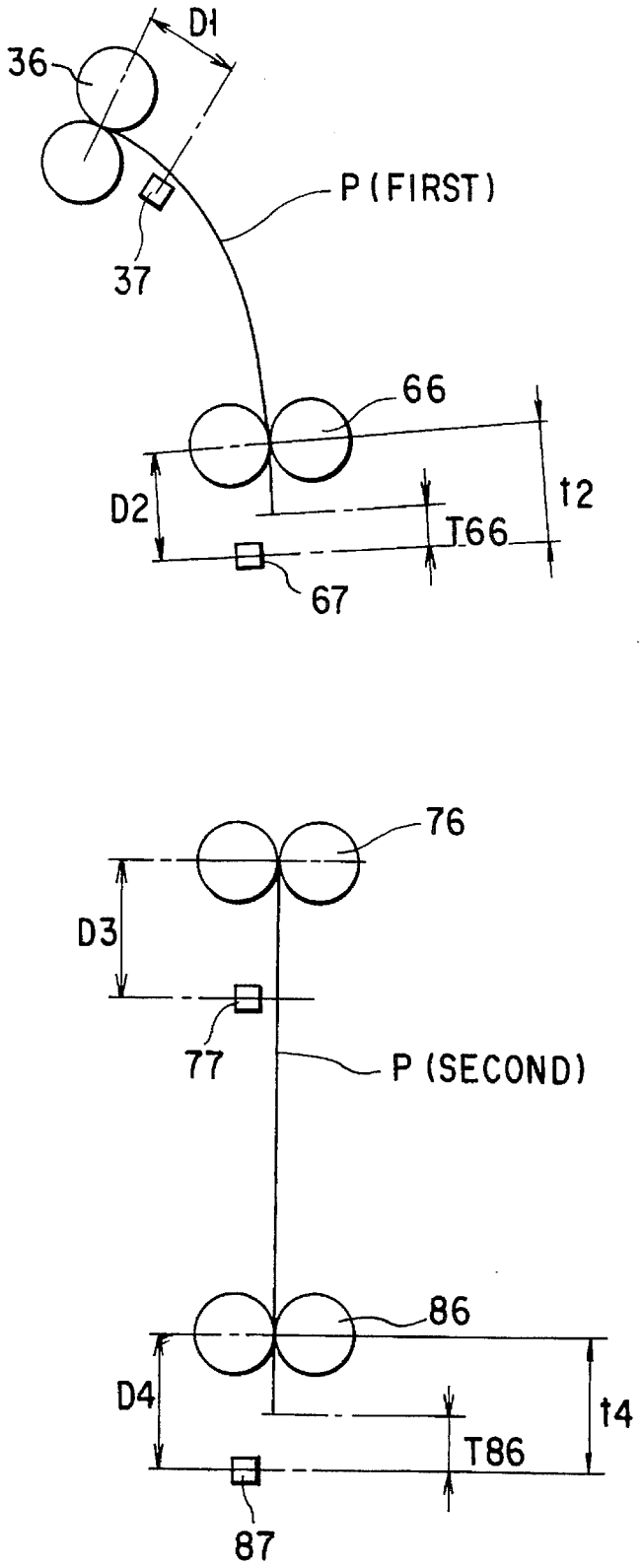
FIGS. 7 to 9 are schematic views showing a state of paper to be conveyed from a cassette of a lowermost stage in the conveying device shown in FIG. 2.

According to FIG. 7, in the case that the paper P is supplied from the cassette 81 of the lower stage of PFP 50, the pickup roller 82 is urged, so that one first paper is picked up from the cassette 81.

The first paper picked up from the cassette 81 is pushed by the roller 83 and 84, and the paper edge sensor 88 is turned off. Thereby, the paper detachment from the cassette 81 is detected and the first paper is conveyed to the path 85.

The entrance of the paper P guided to the path 85 into the lower guide (path) 85 is detected by the aligning sensor 87. Thereafter, the paper P is further conveyed to be guided to the central guide (path) 75 by the roller 86.

The first paper guided to the central guide 75 is passed through the aligning/conveying roller 76, upper guide 65, aligning/conveying roller 66, connecting guide 51, and path 38 in order, and conveyed to the aligning roller 36. At this time, it is detected whether or not the back edge of first paper P is passed through the sensor 67 by the same method as explained in FIGS. 4A and 4B. Also, in the case that the back edge of first paper P is passed, it is detected whether or not the back edge of first paper P is located between the roller 66 and sensor 67 by the same method as explained in FIGS. 4A and 4B. Therefore, the predetermined time $t_2$ is compared with time $T_{66}$, which is from time when paper P is passed through the sensor 67 till the roller 66 is stopped.

On the other hand, when the back edge of the first paper is passed through the aligning sensor 77 (the sensor 77 is turned off), the conveying roller 83 and the separating roller 84 are rotated by the solenoid 110. Thereby, the second paper P sequentially after the first paper P is conveyed to the aligning/conveying roller 86. Thereafter, the second paper P is further conveyed to the aligning/conveying roller 76. At this time, by the position of the back edge of the first paper P, which is stopped by the roller 36, if $t_2>T_{66}$ is satisfied, the rotation of the roller 76 is stopped, and the second paper P is stopped by the roller 76.

In the case that $t_2>T_{66}$ is satisfied, the aligning/conveying roller 86, which pushes the second paper P to the aligning/conveying roller 76, is stopped after a predetermined time $T_3$. In this case, time $T_3$ is time in which a predetermined float $\gamma$ for providing bend to paper P is added to time $t_3$ for which paper is conveyed between the aligning sensor 67 and the aligning/conveying roller 66.

Sequentially, it is detected whether or not the back edge of the second paper P is passed through the aligning sensor 87. If the back edge of the second paper P is passed therethrough, it is detected whether or not the back edge of the second paper P is between the roller 86 and the sensor 87. In other words, in the case that the back edge of the second paper P is passed through the aligning sensor 77, time $T_{86}$ (substantially a distance), which is time from when the second paper P is passed through the aligning sensor 87 of the upper stream of the roller 86 and conveyed, is estimated. Then, time $T_{86}$ is compared with a distance $D_4$ between the sensor 87 and roller 86 and the rotation speed of the outer peripheral surface of the photoconductive drum 21, that is, predetermined time $t_4$, which is defined by the rotation speed of the outer peripheral surface of the roller 86 (time $t_4$ is defined when PFP 50 is manufactured, and stored in ROM 102 in advance).

At this time, if $t_4>T_{86}$, third paper P (not shown) whose top edge portion is drawn from the cassette 81 is stopped by the rollers 83 and 84 until the solenoid 110 is turned on by the timing due to the control of the CPU 101.

Figure 8:
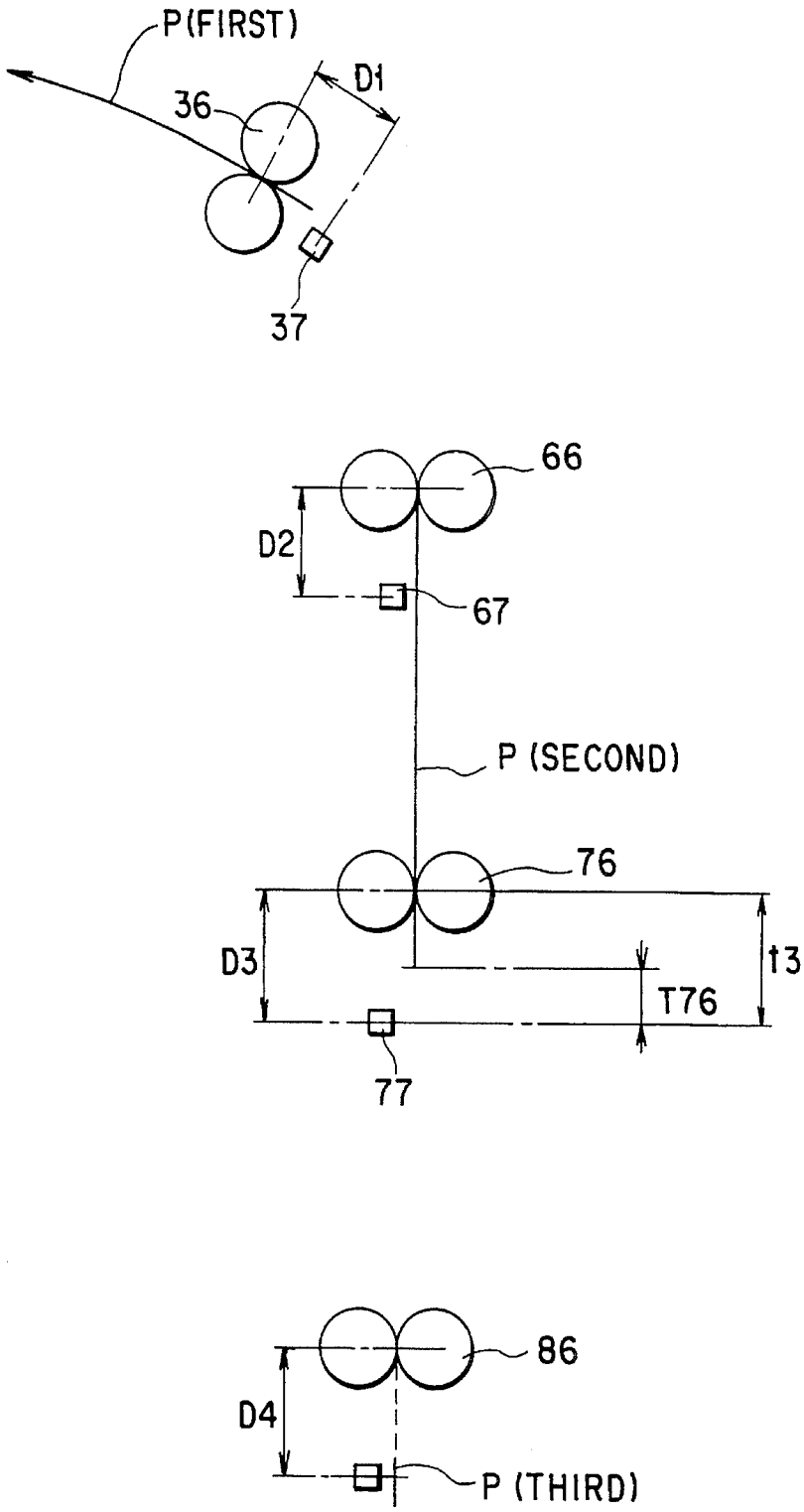

As explained in the example of the cassette 71, in the case that the first paper P, which is stopped by the aligning roller 36, is conveyed to the photoconductive drum 21 and the back edge of the first paper is passed through the aligning sensor 37, the aligning/conveying roller 76 is rotated by the aligning solenoid 109, and the second paper P is conveyed to the aligning/conveying roller 66. Therefore, as shown in FIG. 8, after the top edge of the second paper P is moved to the aligning/ conveying roller 66, it is detected whether or not the back edge of the second paper P is passed through the aligning sensor 77. Then, if the back edge of the second paper P is passed therethrough, it is detected whether or not the back edge of the second paper P is between the aligning/conveying roller 76 and the aligning sensor 77. If $t_3<T_{76}$ is satisfied, the top edge of the third paper P is guided to the aligning/conveying roller 86.

Figure 9:
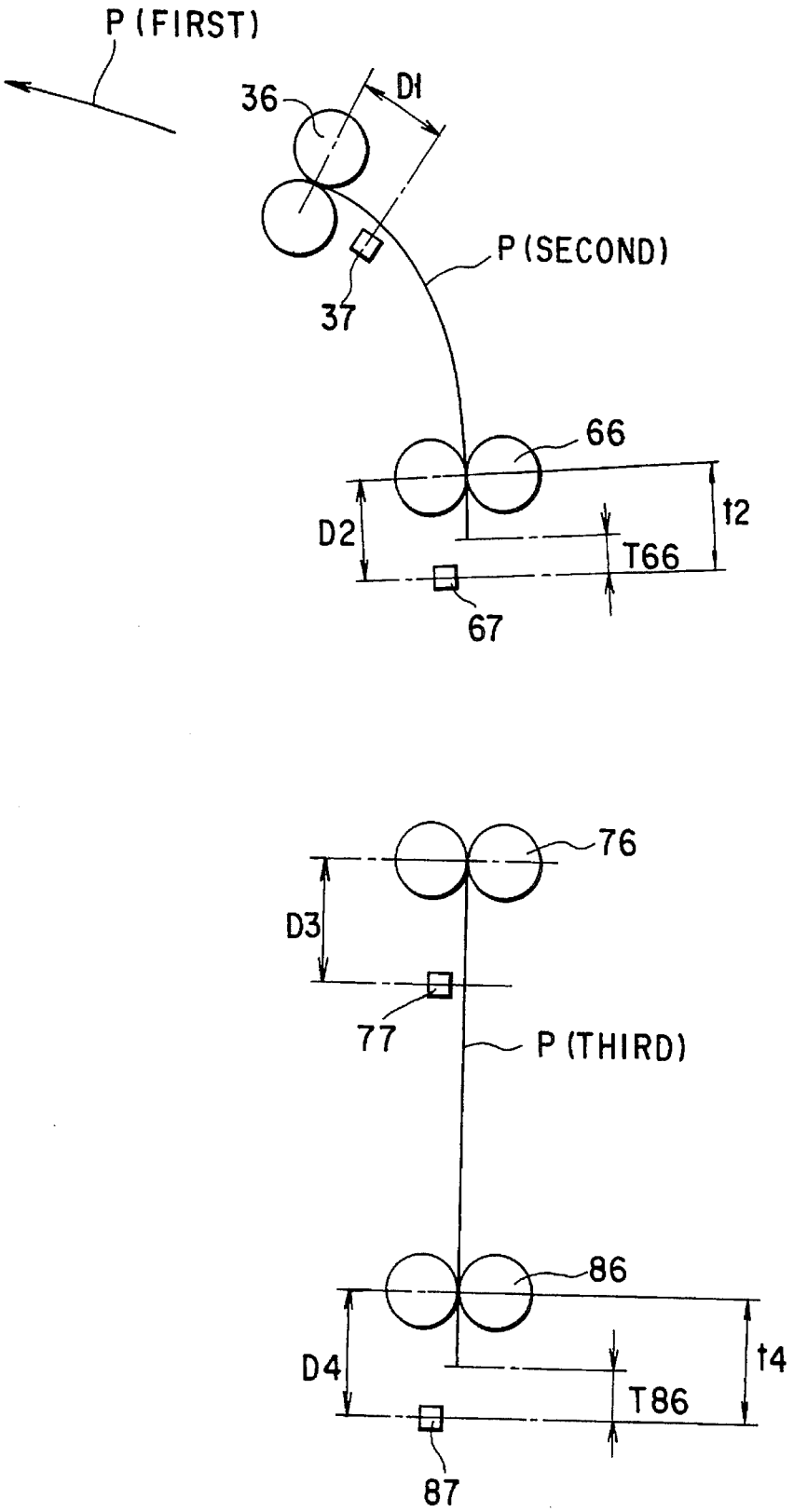

FIG. 9 shows the positions of the papers.

As shown in FIG. 9, the first paper P is completely detached from the aligning roller 36, so that the second paper whose top edge portion is stopped by the aligning/conveying roller 76 is moved to the aligning/conveying roller 66. Then, it is detected whether or not the position of the back edge of the second paper is passed through the aligning sensor 67. If the back edge of the second paper is passed therethrough, it is detected by $t_2$ and $T_{66}$ whether or not back edge of the second paper is between the rollers 66 and 67. If $t_2>T_{66}$ is satisfied, the top edge of the third paper P is guided to the aligning/conveying roller 76.

Thereafter, it is detected whether or not the position of the back edge of the third paper P is passed through the aligning sensor 87. If the back edge of the third paper is passed therethrough, it is detected by $t_4$ and $T_{86}$ whether or not back edge of the third paper P is between the rollers 86 and 87. Then, a next paper (fourth paper) is conveyed to a predetermined position.

Figure 10:
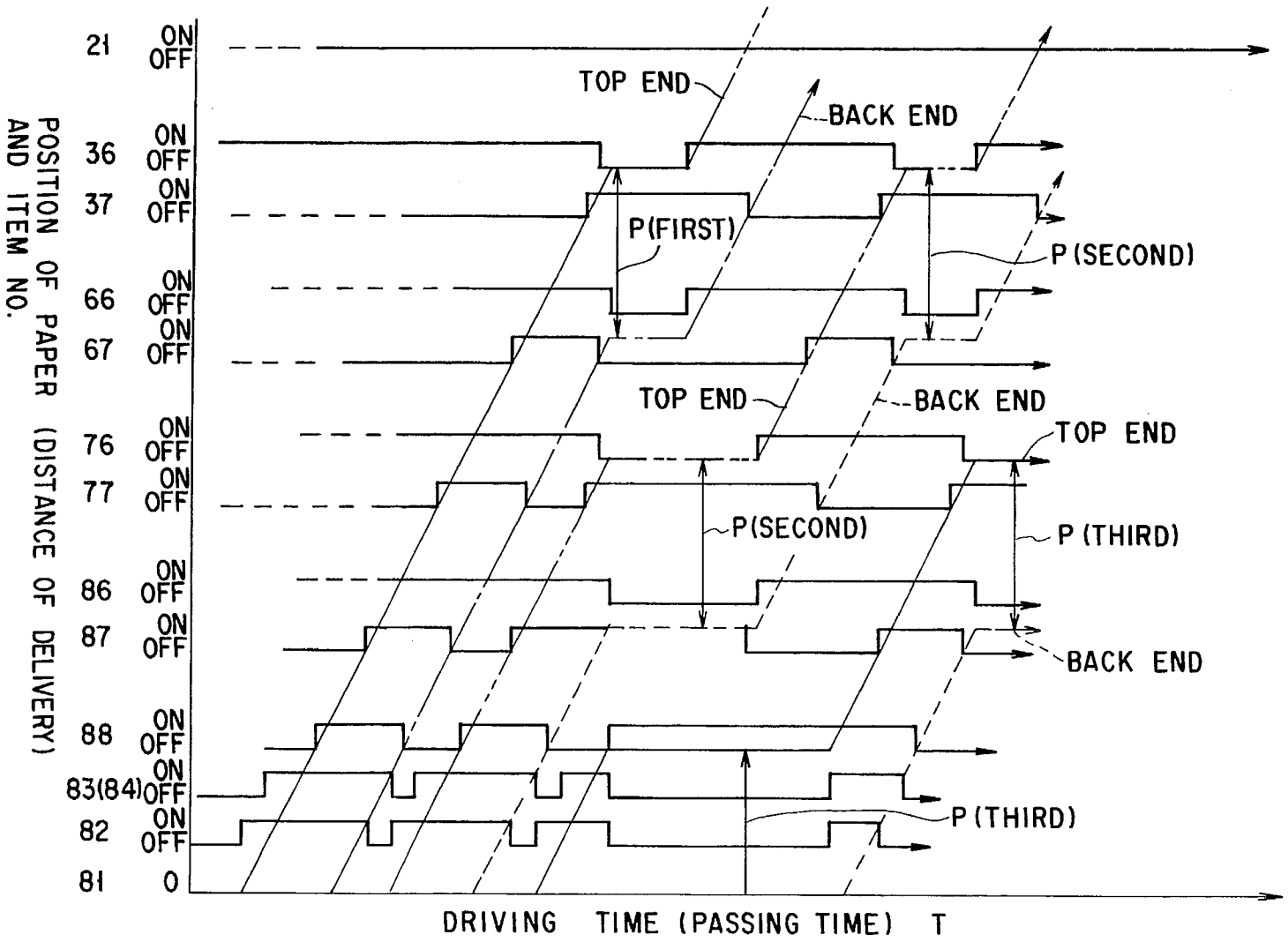
FIG. 10 is a diagram showing timing for controlling rollers to provide the paper conveying state shown in FIGS. 7 to 9.

FIG. 10 shows a diagram schematically showing timing for controlling the aligning roller 36, aligning/conveying roller 66, aligning/conveying roller 76, aligning/conveying roller 86, conveying roller 83, separating roller 84, and pickup roller 82 (cassette 81), which are shown in FIGS. 7 to 9, and showing the state that first paper P and second paper P are moved. More specifically, based on the above-explained detection references, i.e., $t_2>T_{66}$, $t_3>T_{76}$, and $t_4>T_{86}$, it is detected whether or not the paper P is between each of the aligning/conveying rollers and each of the sensors close to each aligning/conveying roller. The continuously supplied paper P is temporarily stopped by the roller, which is positioned at the side of the cassette. Thereby, the papers are prevented from being collided with each other, and being overlapped on each other.

As mentioned above, in the case that the papers P are supplied from the cassette 81, when the first paper P is supplied up to the aligning roller 36 of the copying machine 1, the second paper P is drawn from the cassette 81 in advance, and sequentially, the third paper is drawn from the aligning/conveying roller 76. Therefore, paper conveying time can be reduced in the continuous copying is performed. It is noted that the second paper, which is stopped by the aligning/conveying roller 76, is moved by the aligning/conveying roller 66, so that the third paper is moved to the aligning/conveying roller 86. In this case, each paper is stopped by the aligning/conveying roller 86, aligning/conveying roller 76, aligning/conveying roller 66, aligning roller 36 in order. Moreover, when it is detected by the sensor closer to the photoconductive drum 21 than each roller that there is no paper on the roller closer to the photoconductive drum 21 than the roller to which the paper is being stopped to be conveyed, the paper is moved to the roller close to the photosensitive drum 21 from the roller to which the paper is being stopped to be conveyed. Therefore, for conveying the paper to the photoconductive drum from each cassette, the paper, which is conveyed to the photoconductive drum, and the paper, which is sequentially drawn from the cassette, can be prevented from being overlapped on each other, and time necessary for conveying paper can be reduced.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A paper feeding apparatus for conveying a sheet material along a sheet path, comprising:

means for holding sheet materials;

first conveying means for conveying a first sheet material along the sheet path;

second conveying means, positioned downstream of the first conveying means, for further conveying the first sheet material along the sheet path;

detecting means, provided between said first conveying means and said second conveying means, for detecting that the first sheet material is conveyed from the first conveying means to the second conveying means; and controlling means for controlling said first conveying means to convey a second sheet material when said second conveying means keeps working longer than a predetermined time after the detecting means detects the trailing edge of the first sheet material.

2. A paper feeding apparatus according to claim 1, wherein said controlling means prohibits the first conveying means from conveying the second sheet material when the second conveying means stops within the predetermined time after the detecting means detects the trailing edge of the first sheet material.

3. The paper feeding apparatus according to claim 2, wherein said controlling means senses that the first sheet material passed through said detecting means is detached from said second conveying means based on a working time, which is from the time when the first sheet material is passed through said detecting means till said second conveying means is stopped, and a conveying time obtained by a conveying distance defined based on a conveying speed of said second conveying means and a distance between said first and second conveying means.

4. The paper feeding apparatus according to claim 3, wherein said controlling means stops said first conveying means when the working time of said second conveying means is shorter than the conveying time.

5. The paper feeding apparatus according to claim 3, wherein said controlling means controls said first conveying means to sequentially convey a next sheet material when the working time of said second conveying means is longer than the conveying time.

* * * * *